United States Patent [19]

Meise et al.

[11] 4,395,442

[45] Jul. 26, 1983

[54] METHOD OF COATING THE WORKING SURFACES OF PISTON OPERATING DEVICES

[75] Inventors: Gunther Meise, Hanover; Herbert Unger, Springe, both of Fed. Rep. of Germany

[73] Assignee: Wabco Fahrzeugbremsen GmbH, Hannover, Fed. Rep. of Germany

[21] Appl. No.: 327,338

[22] Filed: Dec. 4, 1981

[30] Foreign Application Priority Data

Dec. 19, 1980 [DE] Fed. Rep. of Germany ..... 3047978

[51] Int. Cl.[3] ..... B05D 7/22

[52] U.S. Cl. ..... 427/236; 29/156.4 WL; 123/193 C; 427/239; 427/386; 427/421; 428/36

[58] Field of Search ..... 427/236, 421, 239, 386; 29/156.4 WL; 123/193 C; 501/1, 105; 428/36; 92/171; 252/12, 25

[56] References Cited

U.S. PATENT DOCUMENTS 4,055,503 10/1977 Anselment et al. ..... 252/12

FOREIGN PATENT DOCUMENTS 52-39047 10/1977 Japan ..... 501/105

*Primary Examiner*—Michael R. Lusignan
*Assistant Examiner*—Thurman K. Page
*Attorney, Agent, or Firm*—J. B. Sotak

[57] ABSTRACT

A method of protecting the frictional engaging surfaces of an aluminum alloy piston-cylinder machine, including the steps of: coating the surface of one of the piston-cylinder members with an epoxy-resin in which is mixed a ceramic oxide material, placing the coated member in a drier oven, and heating and curing the epoxy-resin and ceramic oxide coating for at least one hour at a temperature of approximately 220° C.

5 Claims, No Drawings

METHOD OF COATING THE WORKING SURFACES OF PISTON OPERATING DEVICES

FIELD OF THE INVENTION

This invention relates to a method of protecting the contact surfaces of reciprocating members, such as, the contiguous parts of a piston type of machine, and more particularly, to a process of coating the mating surfaces of a piston and cylinder device with a synthetic resin varnish having a ceramic oxide filler.

BACKGROUND OF THE INVENTION

It will be appreciated that certain aluminum alloys have been found highly acceptable for use in constructing the frictionally engaging piston and cylinder members of compressors or engines. In those instances where weight, heat conduction, economics and mass production are important considerations, it is advantageous to employ a pressure and die-casting process in fabricating the aluminum alloy pistons and cylinders. However, the use of only aluminum base material for both of the friction members, which are exposed to enormous stresses and experience high sliding speeds, generally results in the rapid wear of materials and deterioration during the operation of the piston-cylinder devices. For this reason it is advisable to separate the eutectic or hypereutectic aluminum alloy cylinder member from the eutectic aluminum alloy piston member by coating at least one of the two contact surfaces.

Previously, coating processes of this type were described in the Motor-Technical Journal (MTZ) No. 2/1973 in article entitled "Unsheathed Aluminum Cylinders for Combustion Motors." Further, another specific process of this type was also published in the MTZ No. 2/1974 in an article entitled "Alusil-Cylinder and Ferrocoat-Pistons for the Porsche-Motor 911." When using hypereutectic alloys for the cylinder material, it is common practice to coat the aluminum friction piston member, in order to achieve the separation between the two base metal members. This separation is accomplished by using a coating of iron, chromium, nickel or by using so-called glide varnishes with MOS 2 or graphitic constituents.

Another known method is to coat the inside of the cylinder in a similar manner instead of the piston which is considerably more costly and difficult to achieve.

Presently, it is also common practice to chemically etch the light metal cylinders which are cast from the aluminum alloys, in order to expose the silicon constituents for the purpose of forming a resistant surface.

It will be appreciated that all of the previously known coating processes are relatively costly to carry out and manifestly difficult from a process engineering standpoint.

OBJECTS OF THE INVENTION

Accordingly, it is an object of this invention to provide a new and improved method of coating the mating surface of at lesat one member of a reciprocating machine for reducing frictional wear and increasing the life expectancy.

Another object of this invention is to provide a process of protecting frictionally engaging members by providing a resin varnish and oxide ceramic coating on a reciprocating member.

A further object of this invention is to provide a unique protecting coating on the sliding surface of a piston-cylinder device.

Yet another object of this invention is to provide a unique process of protecting the mating surfaces of a piston-cylinder machine comprising the steps of: coating at least one of the mating surfaces of the piston-cylinder members with a varnish having an epoxy-resin base in which is mixed a ceramic oxide material, placing the varnish coated member into an oven, and heating the varnish coated member at a given temperature for a given period of time.

SUMMARY OF THE INVENTION

Briefly, in accordance with the present invention there is provided a process of protecting the engaging walls of an aluminum alloy piston-cylinder reciprocating pump or motor. The surfaces of the engaging walls of the aluminum piston or cylinder are coated with a varnish having an epoxy-resin base in which is mixed a ceramic oxide material. The ceramic oxide material contains a mixture of sintered aluminum oxide and zirconium oxide. The varnish coat is sprayed on under pressure onto the surface, and the thickness of the varnish coat is between 20 and 40 $\mu$m, and preferably the average thickness is approximately 30 $\mu$m. The varnish coated member is placed in an oven and is heated to a temperature of more than 200° C., and preferably, at a temperature of approximately 220° C.

DETAILED DESCRIPTION OF THE INVENTION

In certain types of machines or mechanical devices, such as air compressors and gasoline engines, it is common practice to construct the cylinder member and the reciprocating piston of a lightweight metal, such as an aluminum alloy. However, these reciprocating machines operate at high speeds and are susceptible to high stresses which give rise to heat and frictional deterioration. That is, the bare working or mating surfaces of the aluminum alloy cylinder and the matching reciprocating piston experience excessive frictional wear and heat degradation. The subject invention alleviates this problem by creating contact surface between the piston and cylinder which exhibits a high heat and wear resistance characteristic. Functionally, there is provided a process for producing such a contact surface, which satisfies the highest demands for the given high speeds and high stresses of such piston type of devices. The method involves the use of a select coating for separating the surfaces of the two eutectic metal members, namely, the piston and the cylinder. The coating or protective surface includes a varnish or other synthetic carrier along with a ceramic oxide filler. The varnish carrier, may be an epoxy-resin base in which is mixed the ceramic oxide material. Thus, the ceramic oxide material may be effectively bonded in synthetic resin varnish when cured to provide a high wear resistance characteristic. The ceramic oxide may be a thorough commingled mixture of aluminum oxide ($Al_2O_3$) and zirconium oxide ($ZrO_3$). Further, upon the initial combination of these two materials, there is obtained an elasticity which guarantees the thorough embedding for extraneous solids. After curing, the coating furthermore supplies an ideal adhesive primer for the wetting lubricants. It will be appreciated that the degree of wear resistance can be influenced by using different quantities of solids percentages. The initial step of coating the surface of the aluminum alloy member is achieved with the aid of pressurized spraying apparatus, such as a spray gun. Normally, only one of the two frictional engaging members is coated so that the logical choice is the piston since it requires less time and effort than coating the inside wall of the cylinder.

After the application of the coating material the piston is placed into an oven or drying furnace. It will be appreciated that the thickness of the finished coating should be between 20 to 40 μm and preferably approximately 30 μm. The coated piston is heated and dried for about one hour in the drying oven which has a temperature of more than 200° C. and preferably approximately 220° C. The heating and curing causes a chemical transformation which results in the desired surface property, namely smoothness and hardness. In most cases, no subsequent working or machining of the surface finish is required.

Although the subject invention has been disclosed and described with reference to a particular application, the principle involved is capable of being employed in other usages which will become readily apparent to those skilled in the art. The present invention is, therefore, to be limited only as indicated by the scope of the appended claims.

Having thus described the invention, what we claim as new and desire to secure by Letters Patent is:

1. A process of protecting the mating surfaces of a piston type of machine including the steps of: coating at least one of the mating surfaces of the piston-cylinder members by spraying under pressure a varnish having an epoxy-resin base in which is mixed a ceramic oxide material which contains sintered aluminum oxide and zirconium oxide, placing the varnish coated member in an oven, and heating the varnish coated member at a given temperature for a given period of time to result in a hardened wear-resistant surface finish.

2. The process as defined in claim 1, wherein the thickness of said varnish coat is between 20 and 40 μm.

3. The process as defined in claim 2, wherein the thickness of said varnish coat is 30 μm.

4. The process as defined in claim 1, wherein the given temperature of the oven is more than 200° C.

5. The process as defined in claim 4, wherein the given period of time is approximately one hour and the given temperature is approximately 220° C.

* * * * *